US006799388B2

(12) United States Patent
Weaver et al.

(10) Patent No.: US 6,799,388 B2
(45) Date of Patent: Oct. 5, 2004

(54) SURFACE WORKING DEVICE AND ATTACHABLE PROTECTOR

(75) Inventors: Steven Weaver, Maryland (AU); Michael Andrew McLean, Hamilton East (AU); Mark James Truebody, Shortland (AU)

(73) Assignee: Sandvik AB, Sandviken (SE)

( * ) Notice: Subject to any disclaimer, the term of this patent is extended or adjusted under 35 U.S.C. 154(b) by 0 days.

(21) Appl. No.: 10/281,351

(22) Filed: Oct. 28, 2002

(65) Prior Publication Data

US 2003/0123934 A1 Jul. 3, 2003

(30) Foreign Application Priority Data

Oct. 26, 2001 (AU) ..... PR8512

(51) Int. Cl.[7] ..... E02F 9/28; E02F 3/36

(52) U.S. Cl. ..... 37/488; 37/450; 37/454; 37/446

(58) Field of Search ..... 32/448, 446, 449, 32/451, 452, 454, 450, 455; 299/36.1

(56) References Cited

U.S. PATENT DOCUMENTS 1,333,852 A * 3/1920 Kittredge ..... 37/450
1,648,783 A * 11/1927 Rosselle ..... 37/448
2,353,685 A * 7/1944 Askue ..... 37/450
2,952,085 A * 9/1960 Petersen ..... 175/383
3,029,534 A * 4/1962 Rakisits ..... 172/701.2
3,456,370 A 7/1969 Gilbertson
3,812,608 A * 5/1974 Ratkowski ..... 37/448
4,028,823 A * 6/1977 Edwards et al. ..... 37/452
4,047,312 A * 9/1977 Stepe ..... 37/448
4,449,309 A * 5/1984 Hemphill ..... 37/444
4,570,366 A 2/1986 Yost
4,601,119 A * 7/1986 Klett ..... 37/448
4,784,517 A * 11/1988 Bergqvist et al. ..... 404/75
5,224,555 A 7/1993 Bain et al.
5,427,191 A * 6/1995 Rickards ..... 175/354
5,680,717 A * 10/1997 Bierwith ..... 37/444
6,213,559 B1 4/2001 Stevens

* cited by examiner

*Primary Examiner*—Robert E. Pezzuto
*Assistant Examiner*—Thomas A Beach
(74) *Attorney, Agent, or Firm*—Burns, Doane, Swecker & Mathis, L.L.P.

(57) ABSTRACT

An end protector for a working element of a road grading machine or the like. The working element includes a body portion having a plurality of holes therein for holding picks that work a road surface. The end protector is held in place through the use of a vacant pick hole of the working element by a fastening element that extends through the hole.

31 Claims, 7 Drawing Sheets

Fig. 16
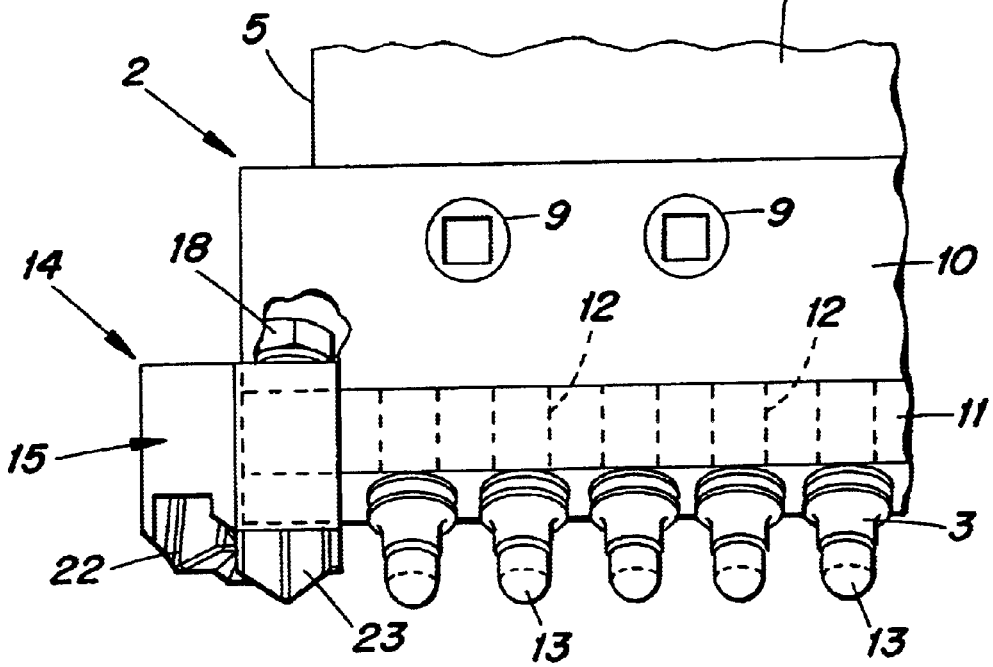
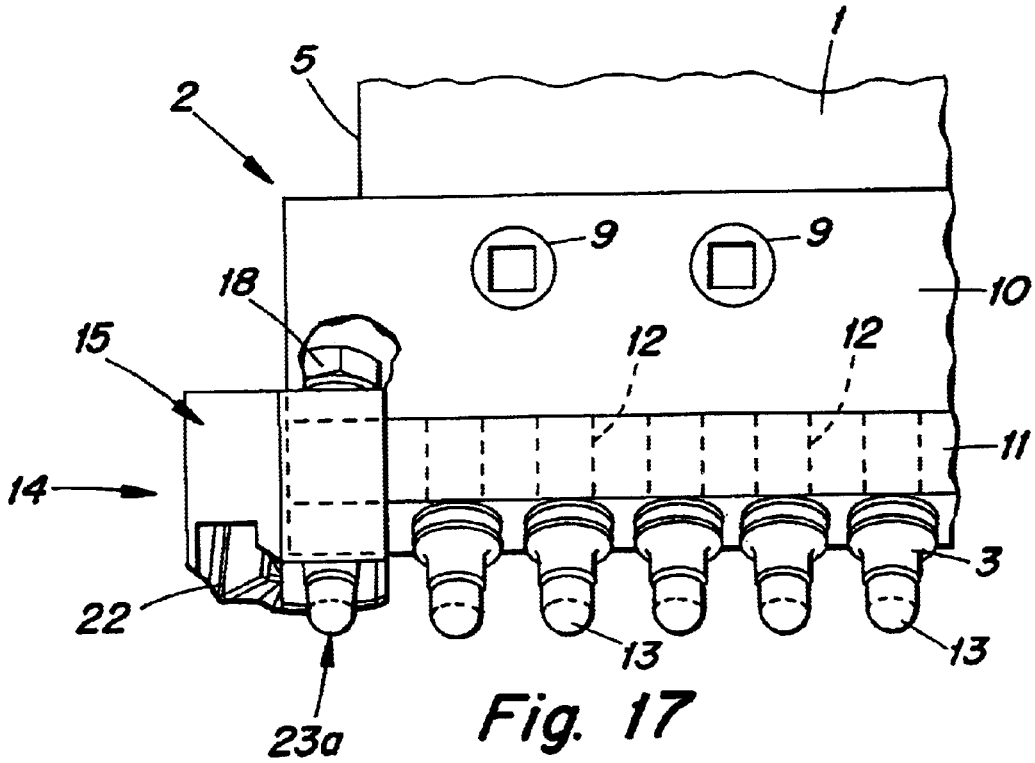
Fig. 17

SURFACE WORKING DEVICE AND ATTACHABLE PROTECTOR

The application claims priority under 35 U.S.C. §§119 and/or Patent Application Serial No. PR8512 filed in Australia on Oct. 26, 2001, the entire content of which is hereby incorporated by reference.

BACKGROUND OF THE INVENTION

The present invention relates to a surface working device, such as for planing and grading roads, and to an attachable protector for the same.

Various road maintenance systems exist for working road surfaces. Such working may for example take the form of grading and planing a road, e.g., in order to provide a dirt road or the like with a smooth driving surface. It could also take the form of for example ice and snow scraping for keeping roads open in winter conditions, as well as asphalt planing and gravel maintenance.

As shown in FIG. 1, such systems typically include a planing blade 1 which breaks up and smooths the surface of a road. The blade 1 is mounted beneath a vehicle between the vehicle's front and rear wheels F and R.

The planing blade 1 is generally angled to the direction of movement D of the vehicle, this angle (denoted $\alpha$ in FIG. 1) being changed dependent on, e.g., the hardness of the surface being worked.

One such known system is the Sandvik System 2000™ provided by Sandvik AB of Sandviken, Sweden.

As shown in FIG. 2, this system utilizes a cutter board 2 that is attached to the planing blade 1 and has a plurality of rotating picks 3 mounted within it. The picks 3 break up the road surface as the grading vehicle advances.

Details of this system can be found in U.S. Pat. No. 4,784,517, the contents of which are incorporated herein by reference.

As the planing blade 1 is angled with respect to the vehicle's direction of motion D, the leading edge 4 of the cutter board 2 (corresponding to the leading edge 5 of the planing blade 1) is subject to wear.

In order to counter this, an end protector 6, shown in FIG. 11, has been devised for the cutter board 2.

This end protector 6 is mounted on the cutter board 2 by bolts 7 (only one shown) which extend through bolt holes 8 of the protector 6 and similar bolt holes 9 in the cutter board 2 and in the blade 1.

The end protector 6 protects the leading edge 4 of the cutter board 2 against wear, and can extend the life of the cutter board 2.

The inventors of the present invention have found, however, that problems can occur when the blade 1 is used to grade or plane hard road surfaces, such as are often found on dirt roads and country tracks.

These problems can include a riding up of the protector 6 over the cutter board 2, so as to expose the leading edge 4 of the cutter board 2 to wear. Furthermore, the bolts 7 holding the protector 6 in place can sometimes loosen and shear off under the loading actions experienced during use.

OBJECTS AND SUMMARY OF THE INVENTION

The present invention aims to provide an alternative end protector that is designed to address such problems.

Viewed from one aspect, the present invention provides an end protector for a working element of a surface working device, the working element having a body portion with a plurality of holes therein for receiving pick elements, wherein the end protector is configured for attachment to the working element by the use of one or more of the pick holes.

From this aspect, therefore, the present invention can be seen to reside in the removal of one or more of the end picks from the working element, e.g., cutter board, so as to allow the end protector to be mounted to the working element through the unused pick hole or holes.

This may be achieved, for example, by having a fastening member, such as a bolt, extend into and/or through the or each empty pick hole and engage the end protector.

The use of one or more of the pick holes to mount the end protector in place provides a secure attachment that resists riding up of the end protector. Furthermore, the orientation of the bolt or other fastener within the pick hole helps to reduce the likelihood of bolt shear or the like.

An end protector attached in accordance with the present invention may provide good protection for the working element when for example it is used in the working of hard surfaces, such as compacted dirt tracks and the like, and may also be used, e.g., in mining board systems for, e.g., open cut mines, quarries and hard rock mines. It may also however be used with working elements in general across the range of working applications, such as ice and snow clearing and the like.

In many situations, the use of one pick hole to mount the end protector may be all that is required. For extra stability, however, one or more further pick holes could be used to mount the end protector, so that for example the two pick holes that are closest to the leading edge of the working element could be used.

The attachment of the end protector to the working element may take any suitable form, as may the shape and construction of the end protector.

In one preferred embodiment, the end protector is configured to slide onto the end of the cutter board, and includes at least one hole or slot that extends over a top and/or bottom opening of one of the end pick holes. A fastening element may then extend through the hole/slot and into the pick hole to hold the end protector in place.

For example, a bolt or other fastener may extend through a hole or slot in an upper face of the end protector, downwardly through the pick hole and into a recess in a lower portion of the end protector. In order to secure the fastener, the recess may for example be tapped or a suitable thread could be provided in the hole or slot in the end protector upper face.

Alternatively, the bolt or fastener could extend in the opposite direction, and as a further alternative, the recess could be replaced by a hole allowing the fastener to extend completely through the end protector and to be fastened by further means, such as a nut or the like.

As well as bolts, other fastening means could be used, for example screw, clip and/or bayonet type constructions could be used, and the bolt may be replaced by some other shaft member or stud element. Other fastening systems could include similar systems to those used to hold the picks in place in the holes, e.g., a split spring sleeve mounted on a bolt or shaft/stud element of the end protector which resiliently engages the insides of the pick holes.

In one preferred embodiment, the fastening element has a shank portion of narrower dimensions, e.g., diameter, than a head portion, e.g. so that the fastening element is of a stepped configuration. The stepped portion may provide a sharp transition or a more gradual curved transition.

In this embodiment, the transition, e.g., stepped, section between the head portion and the shank portion, e.g., a bottom surface of the head portion, may bear against the body portion of the working element so as to provide a force between the end protector and the working element in order to hold or assist in holding the end protector in place. This fastening element may screw into the end protector, and may include a threaded portion at the head portion and/or at the end of the shank portion for engagement with a threaded hole or recess in the protector. When the fastening is provided at the head portion, the shank portion need not be sized to extend completely through a pick hole, and may instead merely extend part way into the pick hole.

Although preferably of one piece construction and slidable onto the end of the working element, the end protector may be of, e.g., two-part construction, in which case the parts could be connected together on mounting the protector to the working element. They may for example be clamped or bolted together or otherwise fastened. In such situations, the actual fastening element of the end protector need not necessarily extend through the vacated pick hole or holes, rather a stud or the like could extend into or through the pick hole to hold the end protector in place, whilst fastening, e.g., the clamping together of the two portions of the end protector, could occur externally of the pick hole.

The end protector may be provided with one or more protective surfaces for protecting the leading edge of the working element on which it is to be mounted. These surfaces may take different forms depending on the use to which the working element is to be put. They may for example vary in size, orientation, number and material. This may depend for example on the type of roads and conditions in which they are designed to be used.

The protective surfaces may be made of a suitably hard material, e.g., a cemented carbide material, such as tungsten carbide, and may form an integral part of or be mounted onto the end protector. The amount of wear-resistant material used, its size and volume may vary depending on the applications and conditions in which it is to be used.

The end protector may include more than one protective surface, so that for example one surface provides more protection when the working blade is oriented in one direction, e.g., angled more towards the direction of travel of the grading vehicle, whilst another surface provides more protection when the working blade is oriented in another direction, e.g., angled more transversely with regard to the direction of movement of the grading vehicle. For example, one surface may provide (the main) protection between about 20° and about 45°, whilst another may provide (the main) protection between about 45° and about 90°.

In one preferred embodiment, the protecting surface or surfaces of the end protector may include one or more tool elements, e.g., of cemented carbide material. Such tool elements may be configured so as to provide a cutting, rolling and/or other working action to a surface during grading.

The end protector may also be provided with one or more tool portions to replace the pick element or elements that are removed from their holes in order to accommodate the end protector. The tool portions may be configured so as to provide a similar cut as the other picks in the working element. In one embodiment, a tool portion is configured so that in use the front tip of the tool portion is set just above the pick points of the picks.

These tool portions may also provide protection to the leading edge of the working element, e.g., when the working element is in a more transverse orientation with respect to vehicle advance.

The tool portions may take any suitable form, and may have a head that is for example similar to that of the picks. They may also be mounted within the end protector for rotation.

The working element will generally be mounted on the blade or the like so that in use it is angled to the vertical, e.g., it is inclined at an angle of about 20° to the vertical. This can expose the back edge of the working element to wear, and the end protector is preferably configured so as to protect this back edge. In one embodiment, a hardened surface of the end protector, e.g., a tool portion, is configured so that, in use, it extends below the position of the back edge of the working element.

Besides being angled to the direction of travel and to the vertical, the working element (and, e.g., the blade to which it is attached) may be positioned in use so that one end is lower than the other, e.g., it is rotated from a horizontal position about an axis extending in the direction of travel of the vehicle or the like to which it is attached. One reason for this is to provide the road surface with a slight angle to provide a run-off for rain. Another situation in which this occurs is when cutting a gutter or similar channel along the edge of a road. The end protector is preferably configured so as to provide protection to the side of the working element during such operations and such blade and working element orientations.

It should be noted that although mention has mostly been made of the mounting of the working element to a blade, the working element may be mounted to any suitable support and device, and for example may be mounted to a moldboard or the like of a vehicle. It should also be noted that the picks 3 are also often referred to as tools and also as pins or bits.

The present invention also extends to a working element having an end protector in accordance with any of the above features; a blade or other support assembly having such a working element; a surface working device having any of the preceding features, and a surface working vehicle having such a blade assembly or any of the other preceding features. It further extends to a method of protecting a leading edge of a working element using an end protector as described above in any of its variations.

Viewed from a further aspect, the present invention provides an end protector for a working element of a surface device, the working element having a plurality of pick holes therein for receiving pick elements, wherein the end protector includes:

a recess for receiving an end portion of the working element, such that at least one of the pick holes lies within said recess; and a fastening element having a shank portion for extending into the pick hole, and a head portion for bearing against the end portion about the pick hole to urge the working element and end protector together.

Viewed from a still further aspect, the present invention provides an end protector for a working element of a surface device, the working element having a plurality of pick holes therein for receiving pick elements, wherein the end protector includes:

a body having a recess for receiving an end portion of the working element, such that at least one of the pick holes lies within the recess; and a fastening element having a shank portion for extending through a first portion of the end protector body, through the pick hole and into a second portion of the end protector body.

Viewed from another aspect, the present invention provides a working element and end protector for a surface working device, wherein:

the working element has a plurality of pick holes therein for receiving pick elements;

the end protector includes a body portion that is mounted on an end portion of the working element, and a fastening element that extends into one of said pick holes for holding the end protector body potion in place on the working element.

In all of the above, the mounting of the end protector in a pick hole of the working element has the further advantages that the end protector can be easily removed and replaced, and that the end protector can be retrofitted to existing blade assemblies.

The invention may also however be seen to reside in the provision of an end protector integrally with the working element. Thus, an end protector of suitable shape could be integral with the working element, e.g., it could comprise a suitably hard material mounted on and about the leading edge of the working element at suitable locations.

Also, the working element could include a suitably formed connection portion to which the end protector may be mounted without the use of a pick hole, this portion being part of the body portion of the working element that houses the picks.

Such a portion could include for example a hole or recess for an end protector fastening element, such as a bolt, the hole or recess not being for the purposes of mounting a pick, but being provided and configured to receive the fastening element and/or a portion of the end protector.

The present invention therefore extends also to an end protector and working element for a surface working device, the working element having a plurality of pick holes therein for receiving pick elements, wherein:

the working element includes a mounting hole therein for mounting the end protector to the working element, said mounting hole being oriented generally in the same direction as the pick holes;

and wherein said end protector includes a fastening element for fastening said end protector to said working element, said fastening element extending into said mounting hole in use.

BRIEF DESCRIPTION OF THE DRAWINGS

Embodiments of the present invention will now be described, by way of example only, with reference to the accompanying drawings. It is to be understood that the particularity of the drawings does not supersede the generality of the preceding description of the invention, wherein:

FIG. 16 is a fragmentary front elevational view of a working element having a protector according to FIG. 4 with a portion of the working element broken away.

FIG. 17 is a view similar to FIG. 12 wherein the protector has a rotatable tool.

DESCRIPTION OF PREFERRED EMBODIMENTS OF THE INVENTION

Figure 1:
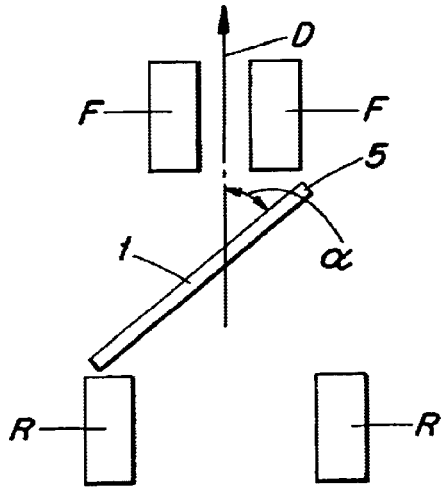
Fig. 1 (PRIOR ART)
FIG. 1 is a schematic plan view showing a typical orientation of the blade of a road grader with respect to the wheels of the grader.

Referring to FIG. 1, a prior art road grader will typically have a grading blade 1 mounted between its front and rear wheels (F and R respectively).

The grading blade 1 is used to break up a road surface in order to level the surface and provide a suitable driving surface for vehicles.

The blade 1 is set at an angle ($\alpha$) to the direction of travel D of the vehicle. This angle may be varied depending on the hardness of the road surface, and so the amount of loading on the blade 1. It will typically range between about 20° and about 90°.

Figure 2:
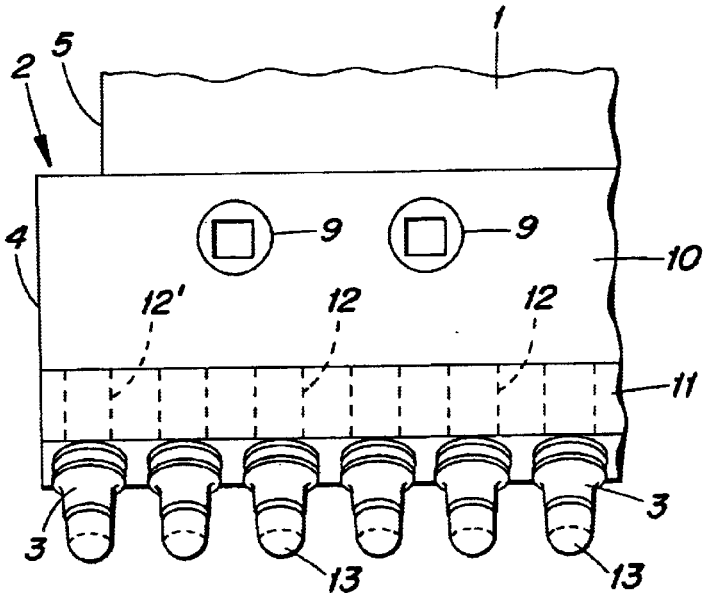
Fig. 2 (PRIOR ART)
FIG. 2 is a front view of one end of a working element mounted to the base of the blade of FIG. 1.
Figure 3:
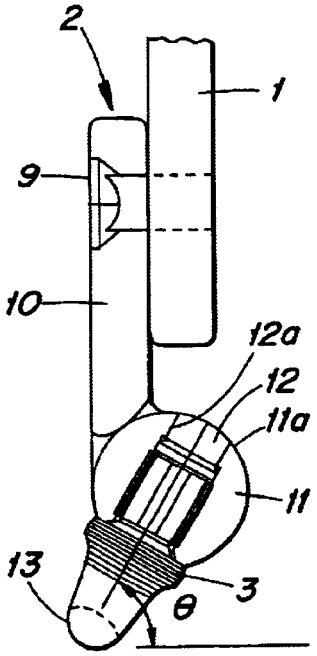
Fig. 3 (PRIOR ART)
FIG. 3 is a cross-section through the working element of FIG. 2 (not to scale).
Figure 4:
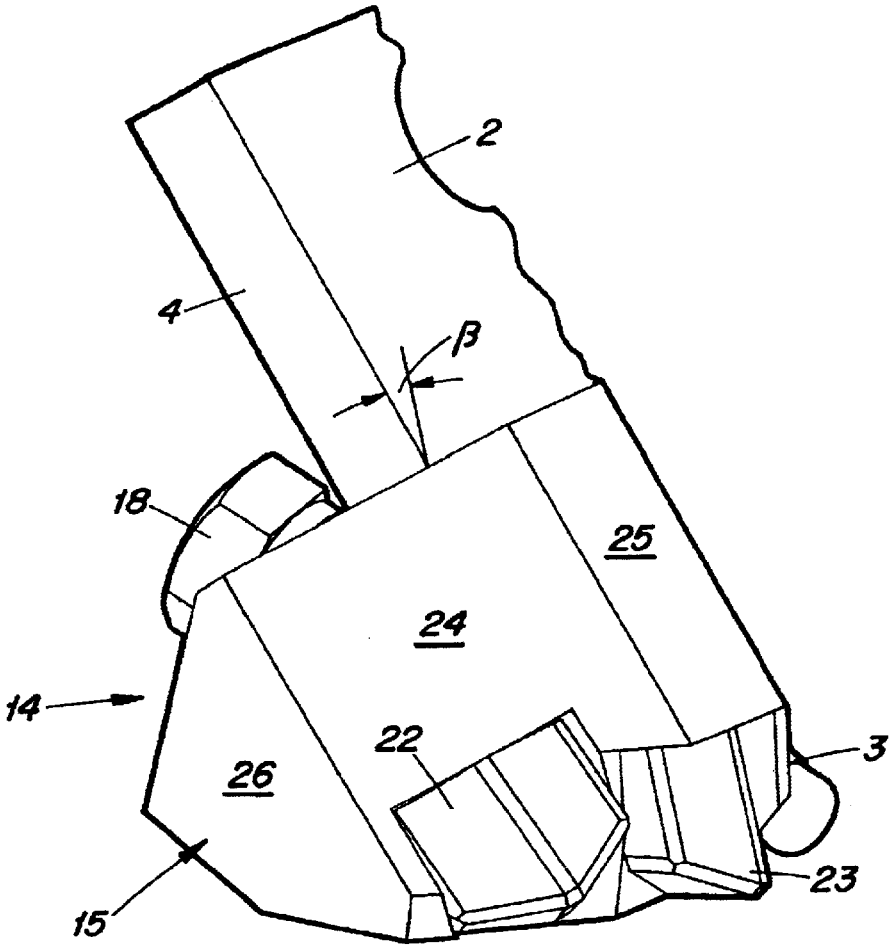
FIG. 4 is a side perspective view of an end protector in accordance with one embodiment of the present invention, mounted on the working element of FIG. 2.
Figure 18:
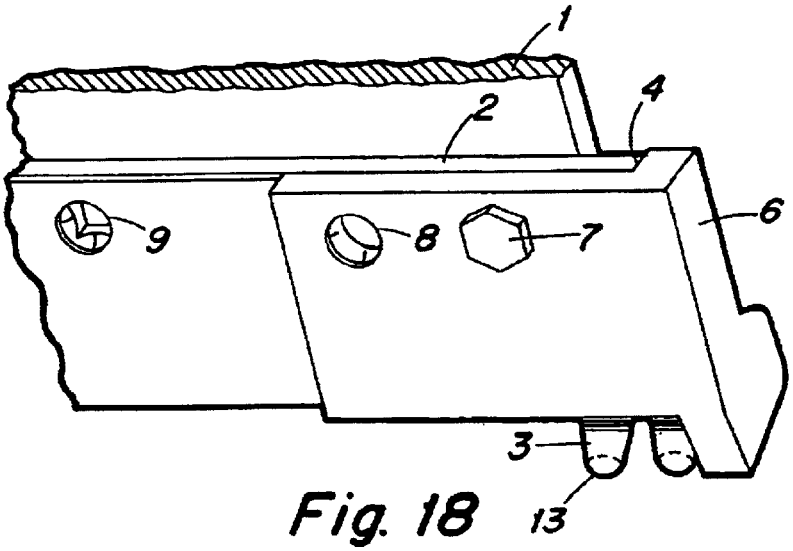
Fig. 18 (PRIOR ART)
FIG. 18 is a side perspective view of a prior art end protector as discussed previously.

As shown in FIGS. 2 and 3, a working element or cutter board 2 is mounted to the lower edge of the blade 1 through bolt holes 9 that are provided in an upwardly extending base portion 10 of the working element 2.

The base portion 10 is welded to a body portion 11 of the base portion that has a plurality of holes 12 therein. Each hole has upper and lower ends. These holes are for rotatably mounting a plurality of picks or tools 3.

Such an arrangement is disclosed in U.S. Pat. No. 4,784,517 entitled "Method and Device for Working of Road surfaces", the contents of which are incorporated herein by reference.

The picks 3 may take many different forms, and may comprise, e.g., sharp, smooth, conical, flat and/or cylindrical tips 13 made from a suitably hard material, such as a cemented carbide material, e.g., tungsten carbide. They provide a cutting and/or a rolling action or other working action for breaking up the surface of a road that is to be graded.

As the blade 1 is angled to the direction of travel D of the road grading vehicle, the leading edge 4 of the working element 2, corresponding to the leading edge 5 of the blade 1, is subject to wear.

In accordance with the present invention, this leading edge 4 of the working element 2 is protected by an end protector 14, shown in FIGS. 4 and 5*a*-5*i*.

The end protector 14 is configured so as to be slidably mounted onto the end of the body portion 11 of the working element 2 and to be fastened in place by the use of a fastening element extending through a pick hole 12' at the leading edge end of the body portion 11 (such pick hole 12' shown in FIG. 2).

Figure 5A:
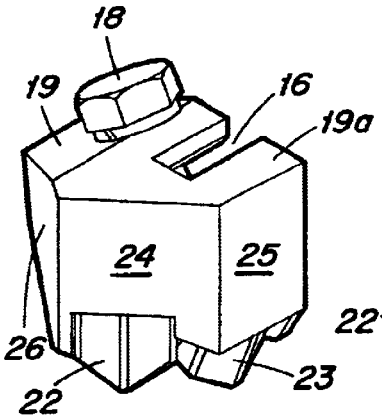
FIGS. 5*a*–5*i* are various views of the end protector of FIG. 4.
Figure 5B:
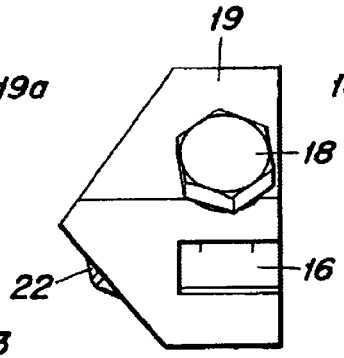
Figure 5C:
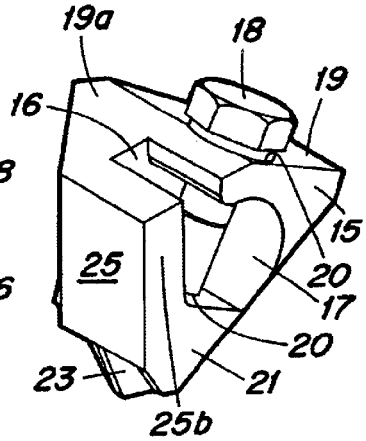
Figure 5D:
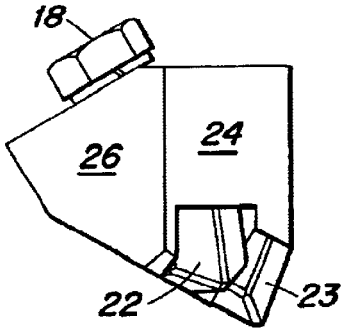
Figure 5E:
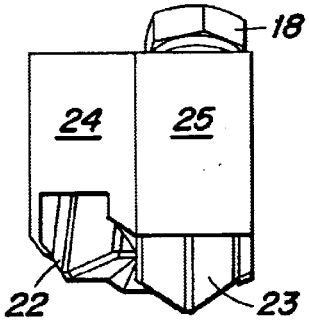

In the shown embodiment, the end protector 14 comprises a main base or body portion 15 that includes a slot 16 and a recess 17 shaped to compliment the profile of the base portion 10 and body portion 11 of the working element 2 (see FIGS. 3 and 5*c*). The end protector 14 can thus slip onto the end of the working element 2 with the end of body portion 11 received in the recess 17 and the leading edge 4 of the working element 5 extending through the slot 16. In such position, the leading pick hole 12' will be aligned with a through-hole 20*a* formed in a top wall 19 of the protector 14 and a threaded (tapped) hole 20 formed in a bottom portion 21 thereof.

The end protector 14 further includes a bolt 18 which in use extends through the hole 20*a*, through the end pick hole 12' of the body portion 11, and into the tapped hole 20.

Figure 5F:
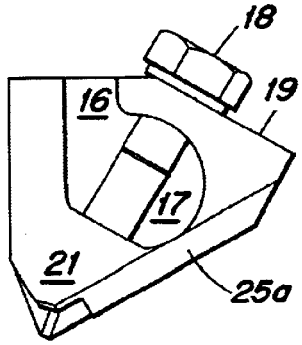
Figure 5G:
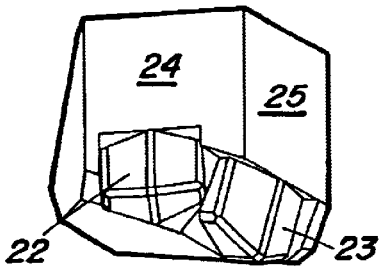
Figure 5H:
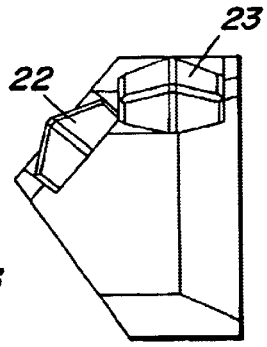
Figure 5I:
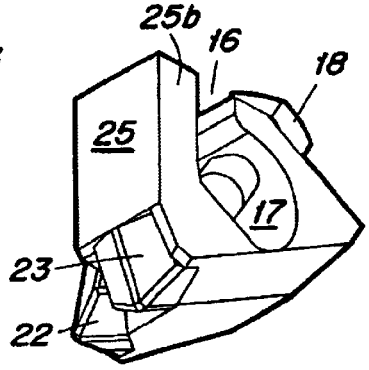

It will thus be appreciated that the end protector includes a top wall 19, 19*a*, a front wall 25, a rear wall 25*a*, and a side wall 25*b*. A cavity 16, 17 is formed between the front and rear walls. The cavity includes an upper portion 16 opening into a portion 19*a* of the top wall, and a lower portion 17 opening into the side wall 25*b*. The upper portion 16 is narrower than the lower portion 17 as viewed in a direction toward the side wall (FIG. 5*f*). The hole 20 is formed in the section 19 of the top wall between the upper portion 16 and the rear wall 25*a* and extends downwardly into the lower portion 17 for receiving the fastener 18.

This mounting of the end protector 14 provides a strong and stable end protector 14 for the working element 2, and helps to resist any tendency of the protector 14 to ride up the working element 2 and expose its leading edge 4 to wear. Also, due to the mounting of the bolt 18 and the ability of the protector 14 to transfer the load acting on it through its mounting on the body portion 11, there is less load on the bolt 18, and so less chance of the bolt 18 shearing or loosening in use.

The end protector 14 is thus particularly useful in situations where hard surfaces, such as dirt tracks and the like, are being graded. It may, however, also be used in any other suitable situations, such as in ice and snow clearing and the like, where it still provides a secure end protector, which is easily attached to and removed from the working element.

The body 15 of the protector 14 may be made of any suitable material, e.g., steel, and in order to provide protection against wear, the protector 14 may include suitable arrangements of harder material, such as cemented carbide material, e.g., tungsten carbide, mounted thereon.

In the shown embodiment, the end protector 14 includes rigidly mounted, downwardly projecting cemented carbide tool elements 22 and 23 to provide the wear protection. The elements 22, 23 are a convenient way of providing a good volume of wear resistant material where required.

Carbide element 22 provides the main protection for the leading edge 4 of the working element 2, and in the form shown comprises a radial tip element normally used in mining machines to provide a raking action. It may however take any other suitable form. This element tends to provide most protection when the blade angle $\alpha$ is in the region of about 20° to about 45°.

Figure 12:
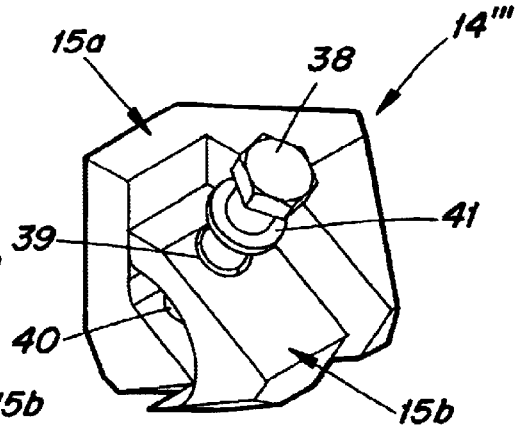

The carbide element 23 in the form shown also comprises a radial tip element. It also provides some protection for the leading edge 4 (especially when the angle of attack $\theta$ of the working element 2 approaches 90°, e.g., between about 45° to about 90°). It also, however, is used to provide a cutting and/or rolling action in the main working operation so as to replace the pick 3 which would otherwise have been mounted in the pick hole 12'. The front tip of the carbide element 23 may be set so that in use it is just above the pick points of the other picks 3 (see FIG. 12).

Figure 13:
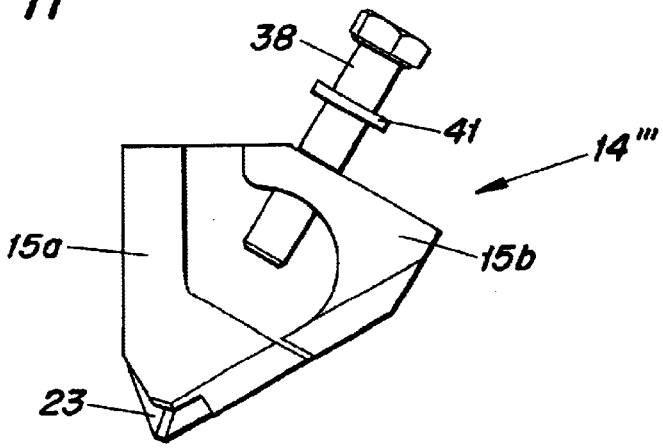
Figure 14:
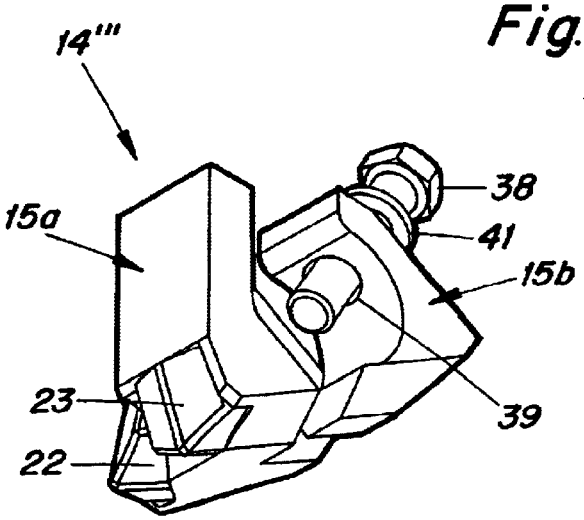
Figure 15:
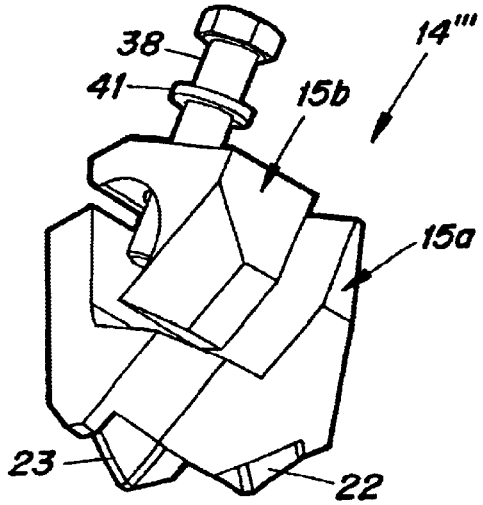

Instead of employing a fixed carbide element 23, an element 23*a* could be used, as shown in FIG. 13, which is rotatable like the picks 13.

In use, the working element 2 tends to be positioned at an angle $\beta$ to the vertical (FIG. 4), which is typically about 20°. This can cause the rear lower edge of the working element 2 to be exposed, and so the main protective carbide element 22 is mounted so as to extend in use below this rear edge in order to protect this edge from wear.

The carbide element 22 may also be configured to provide some cutting action so as to facilitate the forward movement of the leading edge through the worked surface material.

Upright surfaces 24,25,26 of the end protector 14 may also be provided with a hardened surface, e.g., a cemented carbide material such as tungsten carbide, in order to further reduce wear problems, when for example the blade digs deeply into a surface, as can sometimes occur.

Besides being angled to the direction of travel of the vehicle and inclined to the vertical, the blade 1 may also be oriented so that the left or right end is higher above, for example, a road surface than the other end (that is, the blade is rotated about an axis extending in the direction of vehicle travel). This may be to provide an incline to the road surface to allow for run-off of rain, or at a greater angle may be to form or redefine a gutter, drain, or other channel along the side of a road. The end protector 14 may be suitably configured, e.g., with regard to the orientation of the carbide element 22 and/or carbide element 23, so as to provide suitable protection to the cutter board 2 when the blade 1 is so oriented.

Figure 6:
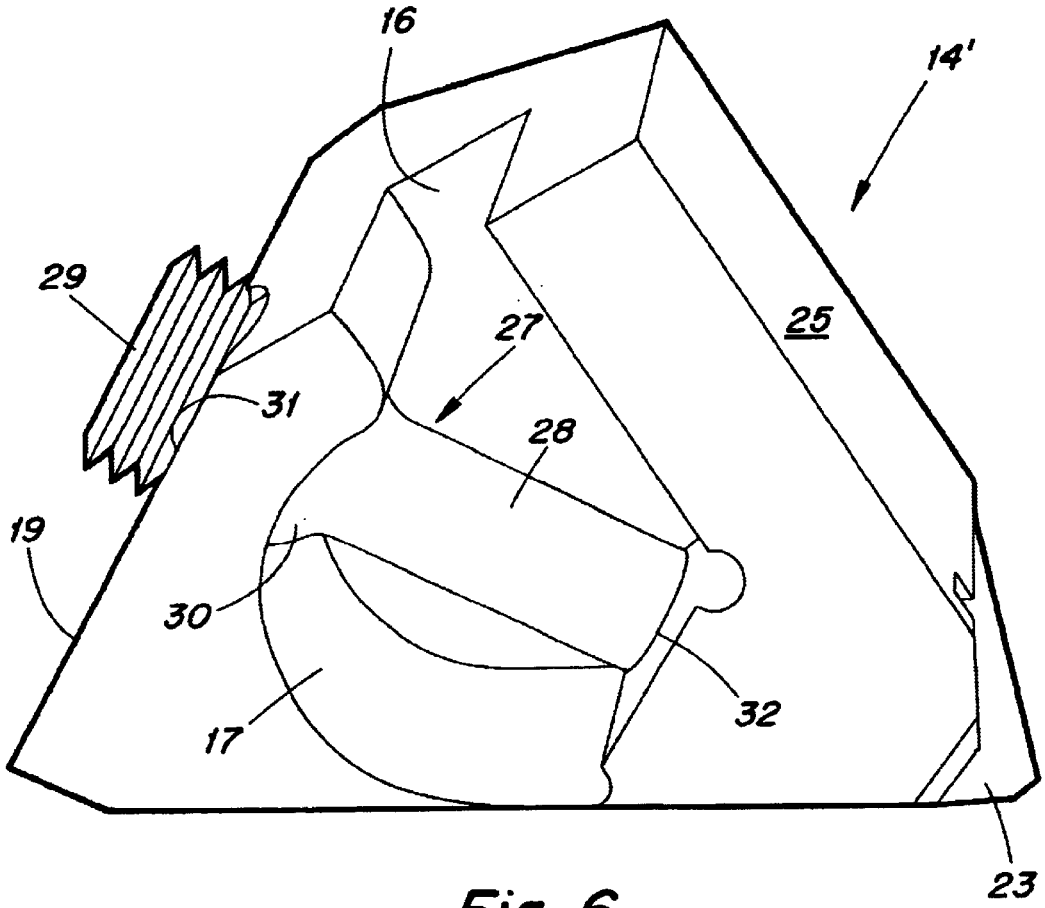
FIG. 6 is a side perspective view of an end protector in accordance with a second embodiment of the present invention.
Figure 7:
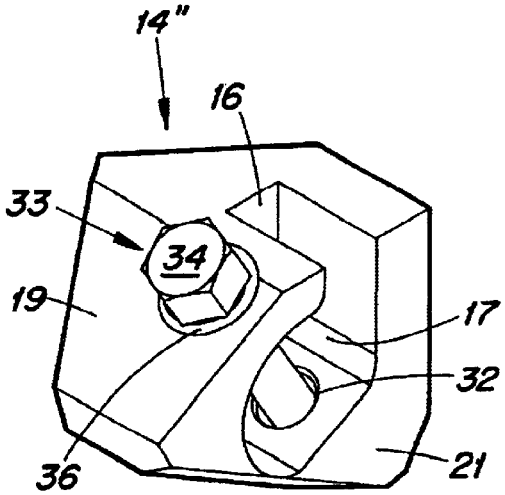
FIGS. 7–10 are various views of an end protector in accordance with a third embodiment of the present invention.
Figure 8:
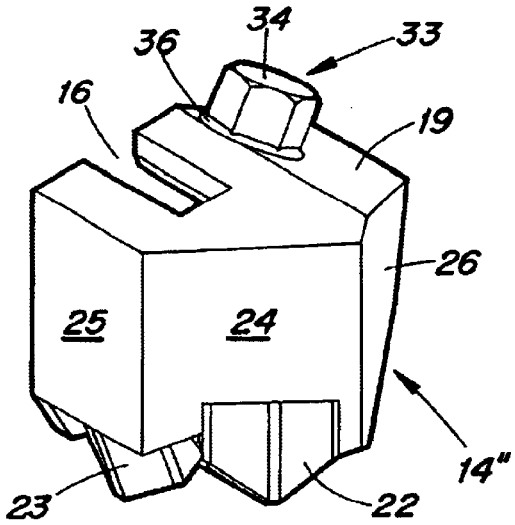
Figure 9:
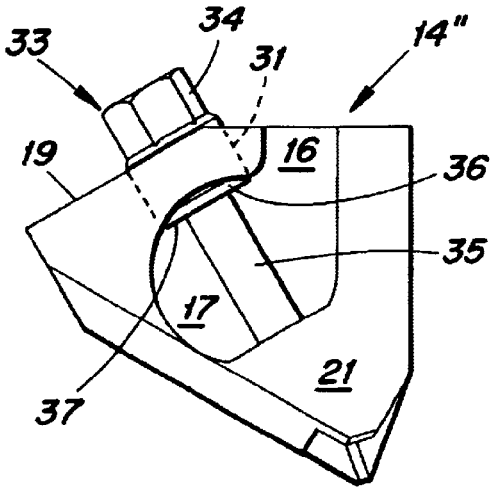
Figure 10:
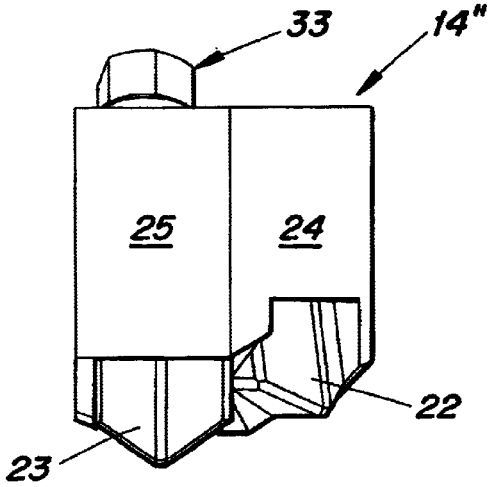
Figure 11:
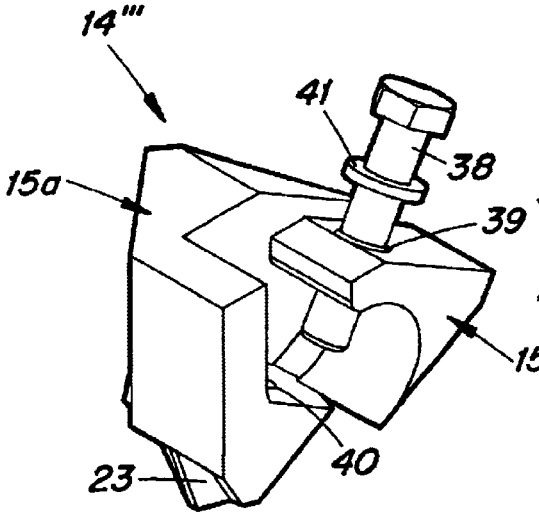
FIGS. 11 to 15 are views of a fourth embodiment of he present invention.

An alternative manner of obtaining an engagement of the working element and the end protector is provided in a second embodiment of the present invention, as shown in FIG. 6.

As can be seen, the protector 14' of this embodiment is similar to that of the first embodiment, although in this case the protector 14' is designed to fit onto the opposite end of the cutter board 2 from that of the previous embodiment. Thus, it would be used when the blade 1 of FIG. 1 is arranged to face to the right.

In this embodiment, the bolt 18 is replaced by a fastening element 27 having a stepped configuration. Thus, the fastening element 27 has a shank portion 28 of a diameter that allows it to pass through the pick holes 12, and a head portion 29 that is of larger diameter than the shank portion 28 and also is of a larger diameter than the pick holes 12 at their top opening 12*a*. The fastening element 27 also has a stepped portion 30 as a transition between the shank portion 28 and head portion 29.

The head portion 29 is threaded, and engages a threaded hole 31 in the top face 19 of the end protector 14'. The shank portion 28 is unthreaded, and extends into a recess 32 in the base portion 21 of the protector 14'. The recess 32 may be of a suitable depth so as to provide some clearance between its bottom 21 and the base of the shank portion 28.

In use, the end protector 14' is slipped onto the end of the body portion 11 of the cutter board 2, and the shank portion 28 of the fastening element 27 is passed through the threaded hole 31, through the pick hole 12', and into the recess 32 in the lower portion of the protector 14'.

The head portion 29 is then screwed into the hole 31, e.g., by engaging a hexagonal socket in the top of the head portion 29. This screwing action forces the stepped portion 30 of the fastening element 27 to bear against the surface 11*a* (see FIG. 3) of the body portion 11 of the working element 2, so as to provide a jacking action and a frictional engagement between the protector 14' and the working element 2. Thus, as the fastening element 27 is tightened into place, the end protector 14' is pulled back tight against the working element 2, thereby limiting movement between the two.

In this embodiment, the fastening element 27 comprises a grub screw which has had its shank portion machined so as to remove the thread and to reduce its diameter. A set screw or socket-headed cap screw could also be used.

A washer, such as a spring washer or non-slip washer, may be provided between the stepped portion 30 and the body portion 11 of the working element 2. Also or alternatively, adhesive may be applied to the thread of the head portion 29 so as to fix the fastening element 27 in place.

In this embodiment, the fastening element 27 need not extend fully through the pick hole 12', and may extend only part way into it.

Instead of providing the threaded engagement at the top of the fastening element 27, it could be provided by, e.g., tapping the recess 32 and providing a thread at the base of the shank portion 28.

FIGS. 7 to 10 show an end protector 14" in accordance with a third embodiment of the present invention, which attaches in a similar manner as the second embodiment, but uses a bolt 33 having a hex end 34, shank 35 and a M30 thread portion 36 therebetween. In use, the base 37 of the thread portion 36 bears against the surface 11*a* (see FIG. 3) of the body portion 11 of the cutter board 2, so as to provide a jacking action and hold the board 2 and protector 14" firmly together.

FIGS. 11 to 15 show an end protector 14'" in accordance with a fourth embodiment of the present invention. This embodiment is similar in construction to the first embodiment, but the main body portion 15 is of a two-part construction, having body portions 15*a* and 15*b* that together define the slot 16 and recess 17.

This embodiment allows the end protector 14'" to clamp onto the body portion 11 of the working element 2. Thus, the two body portions 15*a* and 15*b* are placed about the end of the working element 2, and a bolt 38 is passed through a bolt hole 39 in the top of the second body part 15*b*, through a pick hole 12' of the working element 2, and into a tapped hole 40 in the first body portion 15*a* of the end protector 14'". The bolt 38 is then tightened, i.e., screwed into the taped hole 40, so as to clamp the two end protector body portions 15*a*, 15*b* in place on the working element 2. A spring washer 41 may be provided on the bolt 38.

It is to be understood that various alterations, additions and/or modifications may be made to the parts previously described without departing from the ambit of the present invention, and that, in the light of the teachings of the present invention, the shape of the end protector and its connection to the working element could take many other forms.

For example, the end protector could be mounted using more than one of the pick holes, in order to provide greater stability. In this case, two tool elements 23 could be provided in order to replace the two missing picks.

Instead of using a pick hole to mount the end protector, the working element 2 could be configured with one or more bolt holes on its body portion near its leading edge, oriented similarly to (i.e., parallel to) the pick holes, so that the end protector could be mounted using such a bolt hole rather than one of the pick holes. For example, such bolt hole could be too small in diameter to receive a pick, but large enough to receive a bolt 18.

The shape of the end protector need not be as shown, and could for example have a protective surface with a shape similar to that of the leading edge portion of the prior art end protector 6, without the need for the prior art flanged portion that extends along the face of the working element 2 for bolting to the working element. It could for example take the form of a simple U-shaped mounting element, the arms of which extend on either side of a pick hole for fastening with, e.g., a bolt, which could have a protective surface element mounted thereon and a flange element to help prevent any rotation around the fastener.

As mentioned above, the blade 1, as well as facing to the left of the vehicle (as shown in FIG. 1), could also be oriented to face to the right of the vehicle, and both the above embodiments may be provided in either left and/or right-handed forms. The protector may also be suitably configured so that it may be used at either end of the working element 2. In practice, an end protector will be provided at each end of a working element, and will remain on the element until it wears out, at which point it may simply be replaced by a new one.

In the first embodiment, the protector 14 can be seen to provide a "form locked" grip of the body portion 11 of the cutter board 2, and, in order to also provide a frictional force to hold the protector 14 firmly in place, the end protector 14 could provide a clamping action, and accordingly could be provided with some resilience/elasticity. This may be achieved for example by providing a resilient material between the upper and lower portions of the protector which may be compressed as the bolt is fastened. Also, suitable material may be provided within the recess 17 so as to deform and provide frictional engagement of the body portion 11 as the protector is mounted on the body portion 11 of the cutter board 2.

The end protector may take any suitable shape and size for the working element with which it is to be used. Thus, a standard road grading system may use picks having a shank diameter of 22 mm, whereas a mining board system (which must work in harder conditions, e.g., in open cut mines, quarries and hard rock mines) may use picks having a shank diameter of 25 mm and a larger gauge length. The end protector and its fastener will have dimensions to match these values.

Although the present invention has been described in connection with preferred embodiments thereof, it will be appreciated by those skilled in the art that additions, modifications, substitutions and deletions not specifically described may be made without departing from the spirit and scope of the invention as defined in the appended claims.

What is claimed is:

1. A working element adapted to be carried by a vehicle for working a surface, the working element including a body portion having a front surface and spaced apart pick holes, each pick hole having upper and lower ends, and an end protector disposed at least at one end of the body portion, the end protector mounted to at least one of the pick holes which is pick-free a located at the respective end of the body portion, wherein the end protector covers an end edge of the body portion and a portion of the front surface extending from the end edge the working element further comprising picks mounted to the other pick holes.

2. The working element according to claim 1, wherein the end protector is mounted to the at least one pick hole by a fastening element extending through the end protector and the at least one pick hole.

3. The working element according to claim 2 wherein the fastening element extends at an acute angle relative to the body portion of the working element.

4. The working element according to claim 2, wherein the fastening element has a shank portion sized to fit into a respective pick hole, and a head portion bearing against said body portion.

5. The working element according to claim 4 wherein said shank portion of said fastening element is configured to extend through said respective pick hole and into said body portion.

6. The working element according to claim 5, wherein said shank portion of said fastening element includes a threaded portion for engagement with a threaded hole of said body portion.

7. The working element according to claim 4, wherein said head portion includes a threaded portion for engagement with a threaded hole of the end protector.

8. The working element according to claim 2, wherein said fastening element extends through a first portion of said end protector, through a respective pick hole, and into a second portion of said end protector.

9. The working element according to claim 8, wherein said fastening element engages a threaded recess in said second portion of said end protector.

10. The working element according to claim 1, wherein said end protector is configured to slide onto the end edge of said body portion in a direction generally parallel to a lower edge of the body portion.

11. The working element according to claim 10, wherein said end protector includes a recess therein configured to receive the end of said body portion of said working element.

12. The working element according to claim 1, wherein said end protector is of a two-part construction, and is clamped onto said working element.

13. The working element according to claim 1, wherein the end protector includes at least one hardened protective surface there on for protecting the end edge of the body portion of the working element in use.

14. The working element according to claim 1, wherein the end protector comprises a base mounted to the body portion and at least one downwardly projecting tool element disposed on the base adjacent to a pick.

15. The working element according to claim 14, wherein said tool element provides a hardened protective surface for the end protector.

16. The working element according to claim 14, wherein the tool element is rotatable relative to the base of said end protector.

17. The working element according to claim 1, wherein the working element is part of a road surface working device, and the picks are rotatably mounted in the respective pick holes.

18. A working element adapted to be carried by a vehicle, the working element including a body portion having spaced apart, mutually parallel holes extending generally downwardly therethrough, each of the holes having upper and lower ends, a plurality of picks mounted in some of the holes, and an end protector disposed at least at one end of the body portion, the end protector connected by at least one fastener extending through one of the holes which is unoccupied by a pick and which is disposed within the end protector.

19. The working element according to claim 18, wherein the end protector element includes a downwardly projecting tool element positioned adjacent to a pick.

20. The working element according to claim 19, wherein the tool element constitutes a first tool element, the end protector including a second downwardly projecting carbide tool element disposed adjacent to the first tool element.

21. A working element adapted to be carried by a vehicle for working a surface, the working element including a body having a plurality of pick holes formed therein for receiving picks, each pick hole having upper and lower ends, at least one end of the body having an end protector mounted thereon, the end protector including a recess for receiving the end of the body such that a pick hole is contained within the recess, and a fastening element having a shank portion extending into said contained pick hole, and a head portion for bearing against said body to urge said body and end protector together; the working element further comprising picks mounted in at least some of the other pick hole.

22. A working element adapted to be carried by a vehicle for working a surface, the working element including a body having a plurality of pick holes formed therein for receiving picks, each pick hole having upper and lower ends, at least one end of the body having an end protector mounted thereon, the end protector including a recess for receiving the end of the body such that a pick hole is contained within the recess, and a fastening element having a shank portion extending through a first portion of said body, through said contained pick hole and into a second portion of said body; the working element further comprising picks mounted in at least some of the other pick holes.

23. An end protector for protecting an end of a working element body, the end protector comprising a base having a front wall, rear wall and a side wall, a cavity formed between the front and rear walls, the cavity including an upper portion opening into the top wall, and a lower portion opening into the side wall, the upper portion being narrower than the lower portion as viewed in a direction toward the side wall, a threaded hole formed in the top wall between the upper portion and the rear wall and extending downwardly into the lower portion and receiving a fastener; the fastener including a threaded portion threadedly secured in the top wall.

24. The end protector according to claim 22 further including a tool element projecting downwardly from the base.

25. A method of mounting an end protector to an end of a working element of a surface working device, the working element having a body portion which includes a front surface and a plurality of holes configured for receiving pick elements, each hole having upper and lower ends, the method including the steps of providing at least one of said holes disposed adjacent said end as a pick-free hole, and mounting said end protector thereto, such that the end protector covers an end edge of the body portion and a portion of the front surface extending from the end edge.

26. The method according to claims 25, wherein the mounting step comprises inserting a fastener into said pick-free hole and a hole of said end protector, and securing said fastener to said end protector.

27. The method according to claim 26, wherein said inserting step comprises inserting a shank of said fastener completely through said working element and threadably securing a lower end of said fastener into said end protector.

28. The method according to claim 27 wherein an upper end of said fastener is threadedly secured to said end protector.

29. A working element adapted to be carried by a vehicle or working a surface, the working element including a body portion having spaced part pick holes, each pick hole having upper and lower ends, and an end protector disposed at least at one end of the body portion, the end protector mounted to at east one of the pick holes which is pick-free and located at the respective end of the body portion, the working element further comprising picks mounted to other pick holes; the end protector being mounted to the at least one pick hole by a fastening element extending through the end protector and the at least one pick hole, the fastening element having a shank portion sized to fit into a respective pick hole, and a head portion bearing against said body portion; wherein said head portion includes a threaded portion for engagement with a threaded hole of the end protector.

30. A working element adapted to be carried by a vehicle for working a surface, the working element including a body portion having spaced a part pick holes, each pick hole having upper and lower ends, and an end protector disposed at least at one end of the body portion, the end protector mounted to at least one of the pick holes which is pick-free and located at the respective end of the body portion, the working element further comprising picks mounted to other pick holes; the end protector is mounted to the at least one pick hole by a fastening element extending through the end protector and the at least one pick hole; wherein said fastening element extends through a first portion of said end protector, through a respective pick hole, and into a second portion of said end protector.

31. A working element adapted to be carried by a vehicle for working a surface, the working element including a body portion having spaced a part pick holes, each pick hole having upper and lower ends, and an end protector disposed at least at one end of the body portion, the end protector mounted to at least one of the pick holes which is pick-free and located at the respective end of the body portion, the working element further comprising picks mounted to other pick holes; said end protector configured to slide onto an end of said working element; wherein said end protector includes a recess therein configured to receive an end of said body portion of said working element.

* * * * *